US007849570B1

(12) United States Patent
Steury et al.

(10) Patent No.: US 7,849,570 B1
(45) Date of Patent: Dec. 14, 2010

(54) SPRING WIRE RETENTION DEVICE FOR A CHAIR

(75) Inventors: Robert W. Steury, Goshen, IN (US); Douglas V. Steury, New Paris, IN (US)

(73) Assignee: Veada Industries, Inc., New Paris, IN (US)

( * ) Notice: Subject to any disclaimer, the term of this patent is extended or adjusted under 35 U.S.C. 154(b) by 574 days.

(21) Appl. No.: 11/860,276

(22) Filed: Sep. 24, 2007

(51) Int. Cl.
*F16B 2/22* (2006.01)

(52) U.S. Cl. ..... 24/555; 24/350

(58) Field of Classification Search ..... 24/350, 24/545, 555; 5/259.1, 263, 264.1; 267/99, 267/100; 403/393, 270, 188; 297/452.52
See application file for complete search history.

(56) References Cited

U.S. PATENT DOCUMENTS 3,773,310 A * 11/1973 Crosby ..... 267/110
D330,850 S * 11/1992 Roick ..... D8/367
5,505,436 A * 4/1996 Roick ..... 267/107
6,406,009 B1 * 6/2002 Constantinescu et al. ..... 267/81
7,036,864 B2 * 5/2006 Rehfuss et al. ..... 296/63

* cited by examiner

*Primary Examiner*—James R Brittain
(74) *Attorney, Agent, or Firm*—Botkin & Hall, LLP

(57) ABSTRACT

A spring wire retention device for a chair that includes a spring network with spring wires bridging an opening that defines a seat is disclosed. The spring wire retention device includes a retainer body with an abutment formed therein for preventing movement of the spring wire bridging the opening. A stop member is oppositely disposed from the abutment. Between the abutment and the stop member, a cavity is formed in the retainer body. A resilient member protrudes from within the cavity. The resilient member constantly urges the spring wire against the abutment. The invention may be cast in the form of a ring with a plurality of retainer bodies circumscribing the ring and supporting a spring network.

17 Claims, 4 Drawing Sheets

SPRING WIRE RETENTION DEVICE FOR A CHAIR

BACKGROUND OF THE INVENTION

1. Field of the Invention

This invention relates generally to chairs and seats and, more particularly, to a spring wire retention device for a chair.

2. Description of the Background of the Invention

Certain chair designs include a spring network or similar suspension system that uses spring wire to bridge an opening that defines a seat for supporting a user seated on the chair. A cushion is typically positioned on top of the springs for added comfort. The spring wire spanning the opening must be securely fastened at its opposite ends so that the user and the cushion are adequately supported when resting over the opening. Before the present invention, U-shaped brackets have been used to retain and secure the spring wires. The brackets are typically formed from metal and secured to the frame of the chair by screws, nails, tacks, or other common fasteners.

In addition to becoming loose and failing their intended purpose as time passes, these metal brackets and fasteners oxidize and break. Installing them also requires man hours and delay during manufacture because the spring wire cannot be installed until the fasteners are attached. The step of securing the brackets to the chair also adds to production costs.

There therefore remains a need for a spring wire retention device for a chair, which device does not require the use of brackets or fasteners. The present invention is directed toward meeting this need.

SUMMARY OF THE INVENTION

The present invention relates to a spring wire retention device for a chair of the type that includes a spring network with spring wires bridging an opening, which defines a seat for supporting a user seated on the chair. The spring wire retention device includes a retainer body that has an abutment formed therein to prevent movement of a spring wire bridging the opening. A stop member is provided, which includes a portion that is positioned opposite the abutment. There is also at least one resilient member provided for urging the spring wire toward the abutment.

In one aspect of the invention, a cavity may be formed in the body, and the resilient member may include a portion protruding from within the cavity.

In another aspect, the spring wire retention device may include a pair of retainer bodies. The pair of retainer bodies may be carried by the underside of the seat in spaced apart fashion, and the spring wire may extend between the bodies and bridge the opening that defines the seat. The spring wire may be in contact at opposite ends, respectively, with the abutment when the user is seated on the chair.

In still another aspect, the retainer body may define a ring. The ring may carry a plurality of retainer bodies. In another aspect, the ring and the retainer bodies may be integrally cast.

In yet another aspect, the stop member may define the resilient member.

In another aspect, the abutment may include a curved face, and the spring wire may be in contact with the curved face when the user is seated on the chair.

One object of the present invention is to provide an improved spring wire retention device for a chair, which device does not require brackets or fasteners to secure and retain the spring wire. Related objects and advantages of the present invention will be apparent from the following description.

DETAILED DESCRIPTION OF INVENTION

Figure 1:
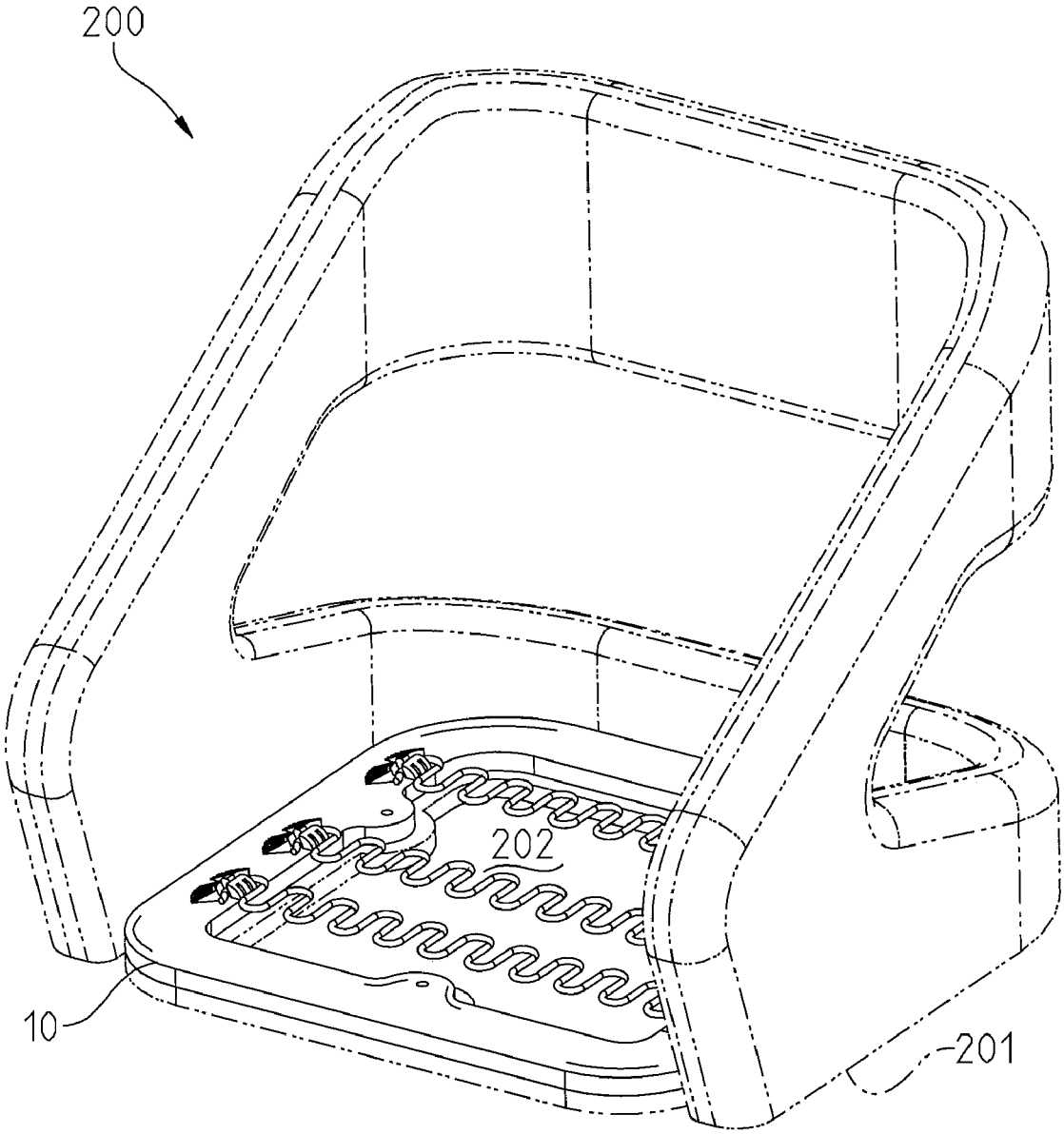
FIG. 1 is an elevated perspective view showing an embodiment of the ring of the invention and a chair environment in phantom lines, which form no part of the invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
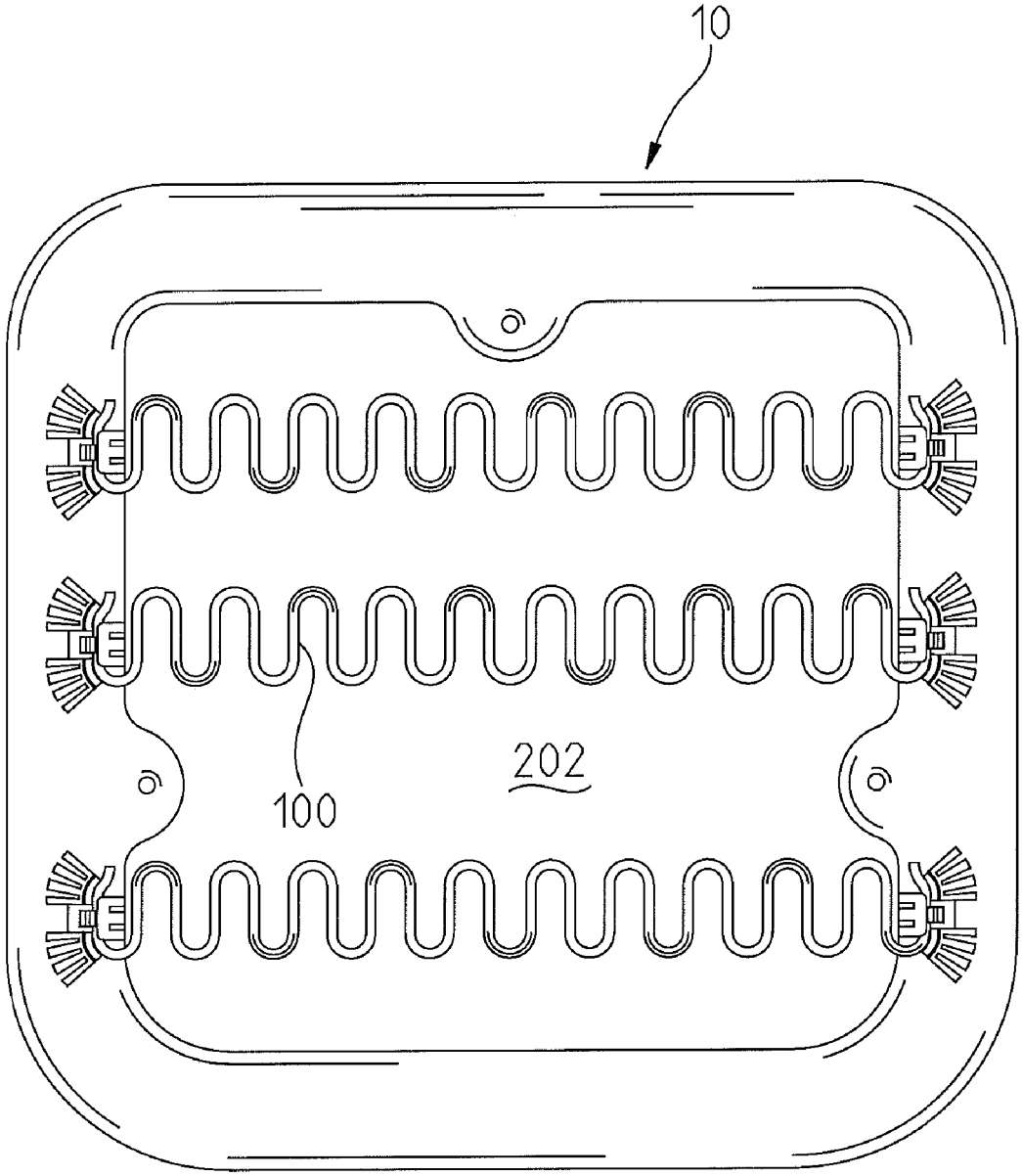
FIG. 2 is a top plan view showing the ring of the invention with spring wires positioned in the retainer bodies.

With reference to the figures, a spring wire retention device for a chair 200 is shown as a single retainer body 40 (FIG. 6) or, in another embodiment, as a plurality of retainer bodies carried by a ring 10, as shown in FIGS. 1 and 2. The spring wire retention device is generally intended for chairs of the type having a spring network with spring wires 100 bridging an opening 202 that defines a seat for supporting a cushion and a user seated on the chair 200.

The spring wire retention device includes a retainer body 40 that has an abutment 50 bearing the majority of the weight displaced on the seat via springs 100 when in use. The retainer body 40 includes a stop member 60 and a resilient member 80, both of which extend upwardly from the surface of the retainer body 40. In an embodiment, each of the aforementioned members 50, 60 and 80 are integrally cast with the retainer body 40. Brackets and fasteners are unnecessary as a result. In an embodiment, the retainer body 40 is formed from plastic. The inventor has had success using plastic, but such material is not meant to be limiting. Die cast molds, thermo plastics or other means known by skilled artisans can be used to produce the retainer body 40. The physical properties of the retainer body 40 must be such, however, that the retainer body is essentially rigid and the resilient member somewhat pliable to effectively serve the purpose as herein later described.

Figure 3:
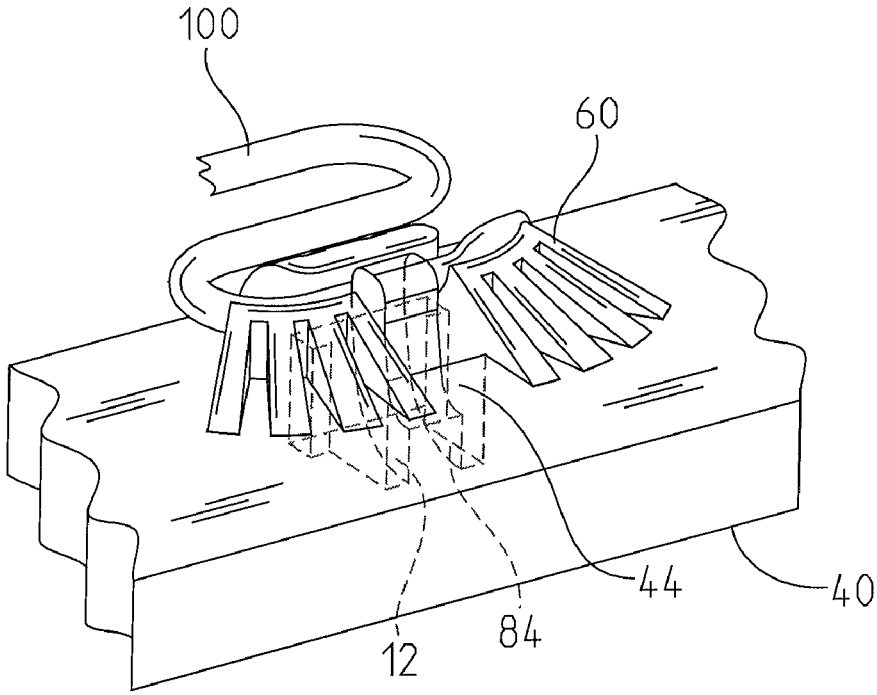
FIG. 3 is a partial transparent perspective view of an embodiment of the retainer body of the invention.
Figure 4:
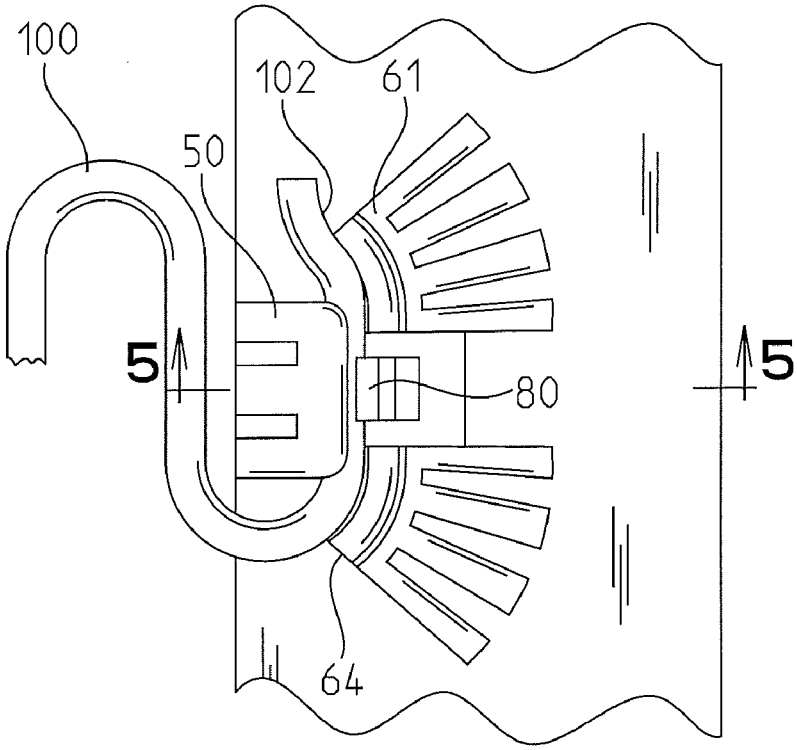
FIG. 4 is top plan view of an embodiment of the retainer body of the invention shown with a spring wire positioned in the retainer body.
Figure 5:
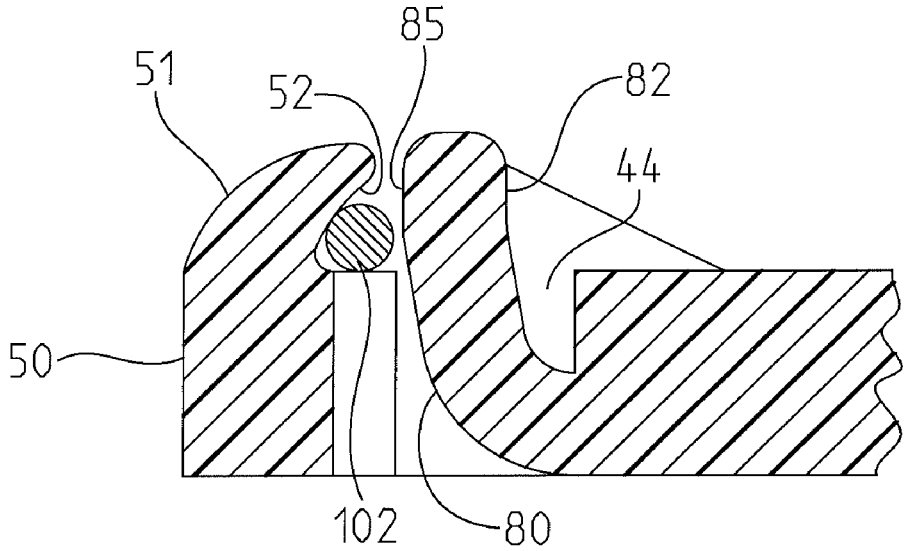
FIG. 5 is a cross-section of an embodiment of the retainer body of the invention taken along line 5-5 of FIG. 4
Figure 6:
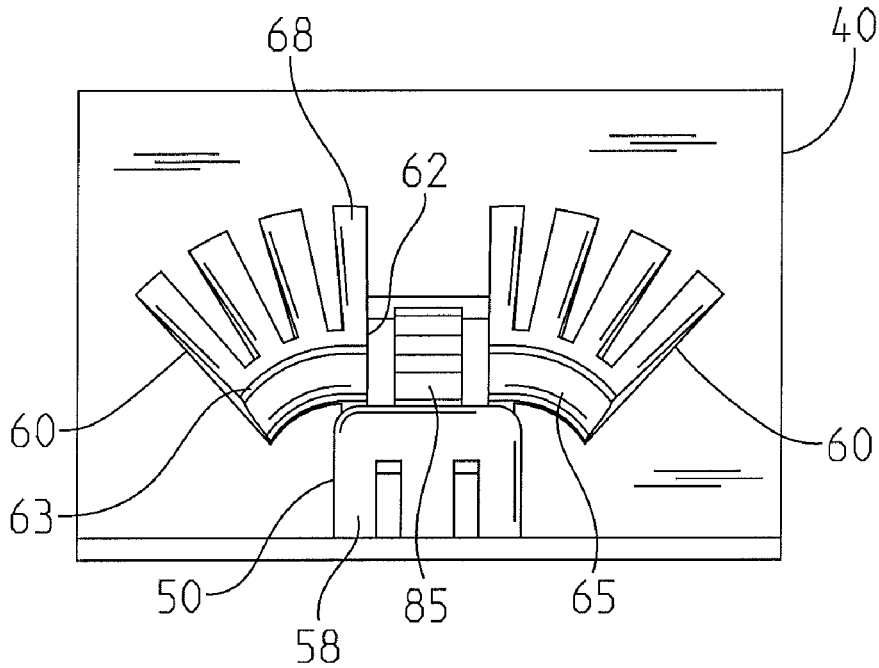
FIG. 6 is a top perspective view showing an embodiment of the retainer body of the invention.

Referring to FIGS. 4-6, the abutment 50 extends upwardly from the surface of the retainer body 40 and includes a curved face 52, which contacts the end 102 of the spring wire 100. Curving rearwardly and away from the top back side 51 of the curved face 52 are fingers 58 for providing additional support strength for supporting the spring wire 100. The stop member includes an upstanding portion 62 positioned opposite the abutment 50. In one embodiment (not shown), the stop member 60 defines the resilient member 80. In that embodiment, the material used to make the retainer body 40 may be different from that preferred by the inventor so as to yield the physical properties, as hereinabove described. In another embodiment, the stop member defines a pair of stop members 60, as shown in FIGS. 3, 4 and 6.

The stop member includes a forward wall 64 opposite the curved face 52 of the abutment 50. The forward wall 64 has a curved portion 65 and a straight portion 63 above and below the curved portion. Sloping rearwardly away from the top back side 61 of the forward wall are obliquely arranged fingers 68, which support and strengthen the stop member 60 upon the retainer body 40.

As illustrated in FIG. 3, a cavity 44 is formed in the retainer body 40 between the stop members 60. The resilient member 80 has a portion 82 protruding from within the cavity 44 for urging the end 102 of the spring wire 100 against the front face 85 of the abutment 50, which helps prevent the spring wire from escaping from its cradled position shown in FIG. 5. In one embodiment, the cavity 44 is a bore that extends through the retainer body 40, as shown in FIG. 3. In that embodiment, the cavity has a surface 12 to which the resilient member 80 is connected at its base 84, thus allowing the top portion 82 of the resilient member to be releasably depressed rearwardly away from the face 52 of the abutment 50 so that the spring wire 100 can be placed in the cradle position illustrated. Once the spring wire 100 is in position, the top portion 82 of the resilient member 80 may be released so that it resumes its natural position constantly urging the spring wire against the curved face 52.

In one embodiment, a plurality of retainer bodies 40 may be secured underneath a chair 200 in pairs disposed on opposite sides of the opening 202. In that embodiment, an end 102 of a corresponding spring wire 100 is retained by retainer bodies 40 as described above so as to bridge the opening 202 that defines the seat of the chair 200. In another embodiment, the retainer body 40 defines a ring 10, as shown in FIG. 2. In that embodiment, the abutments 50, stop members 60 and resilient members 80 are integrally cast, and the retainer body defines a ring 10. When a user rests on a cushion (not shown) positioned above opening 22, the spring wires 100 are pulled inwardly so that their respective ends bear upon the curved face 52 of abutments 50. The spring wire retainer bodies 40 do not require brackets for supporting and retaining the spring wire. As a result, fasteners, such as nails, screws and tacks are not needed.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A spring wire retention device for a chair of the type having a spring network with spring wires bridging an opening that defines a seat for supporting a user seated on the chair, the spring wire retention device having a retainer body with an abutment formed therein for preventing movement of a spring wire bridging said opening, a stop member, said stop member including a portion being positioned opposite said abutment, and at least one resilient member for urging said spring wire toward said abutment.

2. A spring wire retention device according to claim 1, wherein a cavity is formed in said body, and said at least one resilient member includes a portion protruding from within said cavity.

3. A spring wire retention device according to claim 1, wherein said device includes at least a pair of retainer bodies, said pair of bodies being carried by an underside of said seat in spaced apart fashion, and said spring wire extending between said bodies and bridging said opening that defines said seat, said spring wire being in contact at opposite ends, respectively, with said abutment when the user is seated on the chair.

4. A spring wire retention device according to claim 1, wherein said retainer body defines a ring, and said ring carries a plurality of retainer bodies.

5. A spring wire retention device according to claim 4, wherein said ring and said retainer bodies are integrally cast.

6. A spring wire retention device according to claim 1, wherein said abutment includes a curved face, said spring wire being in contact with said curved face when the user is seated on the chair.

7. A spring wire retention device for a chair of the type having a spring network with spring wires bridging an opening that defines a seat for supporting a user seated on the chair, the spring wire retention device having a retainer body including an abutment upwardly extending from the body for preventing movement of a spring wire when said spring wire bridges said opening, a stop member having a forward wall with a straight portion and a curved portion for guiding said spring wire into a cradle position, said wall being positioned opposite the abutment, and at least one resilient member for urging said spring wire toward said abutment.

8. A spring wire retention device according to claim 7, wherein a cavity is formed in said body between said abutment and said stop member, and said at least one resilient member includes a portion protruding from within said cavity for urging said spring wire toward said abutment.

9. A spring wire retention device according to claim 7, wherein said device includes at least a pair of retainer bodies, said pair of bodies being carried by an underside of said seat in spaced apart fashion, and said spring wire extending between said bodies and bridging said opening that defines said seat, said spring wire being in contact at opposite ends, respectively, with said abutment when the user is seated on the chair.

10. A spring wire retention device according to claim 9, wherein said stop member defines a pair of stop members, each of said pair of stop members having fingers extending rearwardly from the forward wall for supporting said stop member.

11. A spring wire retention device according to claim 9, wherein said abutment includes a curved face, and said abutment having fingers extending rearwardly from the face for strengthening said abutment.

12. A spring wire retention device according to claim 7, wherein said retainer body defines a ring, and said ring carries a plurality of retainer bodies.

13. A spring wire retention device according to claim 12, wherein said ring and said retainer bodies are integrally cast.

14. A spring wire retention device according to claim 13, wherein said stop member defines a pair of stop members, each of said pair of stop members having fingers extending rearwardly from said forward wall for strengthening said stop members, a plurality of cavities are formed in said ring, each of said cavities being positioned between a corresponding pair of stop members, a plurality of resilient members each with a portion protruding from within each of said cavities for urging, respectively, a spring wire toward an abutment corresponding with each of said cavities.

15. A spring wire retention device according to claim 14, wherein each end of said spring wires contacts a respective one of said corresponding abutments when the user is seated on the chair.

16. A spring wire retention device according to claim 15, wherein said cavities define bores extending through said ring.

17. A spring wire retention device according to claim 16, wherein said cavities each having a surface from which said resilient member depends.

* * * * *